US011624133B2

(12) United States Patent
Pacheriwala

(10) Patent No.: US 11,624,133 B2
(45) **Date of Patent: *Apr. 11, 2023**

(54) WOVEN FABRIC MADE OF COTTON OR REGENERATED CELLULOSE FIBERS OR A COMBINATION THEREOF AND POLYESTERS

(71) Applicant: Vishal Pacheriwala, Mumbai (IN)

(72) Inventor: Vishal Pacheriwala, Mumbai (IN)

(73) Assignee: Vishal Pacheriwala, Mumbai (IN)

( * ) Notice: Subject to any disclaimer, the term of this patent is extended or adjusted under 35 U.S.C. 154(b) by 386 days.

This patent is subject to a terminal disclaimer.

(21) Appl. No.: 16/427,816

(22) Filed: May 31, 2019

(65) Prior Publication Data

US 2019/0284733 A1 Sep. 19, 2019

(30) Foreign Application Priority Data

Apr. 4, 2019 (IN) ..... 201821044771

(51) Int. Cl.

| | |
|---|---|
| ***D03D 15/20*** | (2021.01) |
| ***D03D 47/30*** | (2006.01) |
| ***D03D 15/47*** | (2021.01) |
| *D03D 15/225* | (2021.01) |
| *D03D 15/00* | (2021.01) |
| *D03D 15/217* | (2021.01) |

(Continued)

(52) U.S. Cl.

CPC ..... *D03D 47/3046* (2013.01); *D03D 15/47* (2021.01); *D03D 15/00* (2013.01); *D03D 15/20* (2021.01); *D03D 15/208* (2021.01); *D03D 15/217* (2021.01); *D03D 15/225* (2021.01); *D03D 15/283* (2021.01); *D10B 2201/02* (2013.01); *D10B 2331/04* (2013.01)

(58) Field of Classification Search

CPC ..... D03D 15/00; D03D 15/20; D03D 15/208; D03D 15/217; D03D 15/225; D03D 15/283

USPC ..... 442/181, 203, 208, 209, 213, 214, 216; 139/11, 192, 349, 370.1, 420 A, 420 R, 139/420 B

See application file for complete search history.

(56) References Cited

U.S. PATENT DOCUMENTS

| | | |
|---|---|---|
| 4,100,725 A | 7/1978 | Magel |
| 5,487,936 A | 1/1996 | Collier |

(Continued)

*Primary Examiner* — Matthew D Matzek

(74) *Attorney, Agent, or Firm* — Shumaker, Loop & Kendrick, LLP

(57) ABSTRACT

Woven fabric made of cotton yarn or regenerated cellulose fibers yarn or a combination thereof and polyesters. The woven fabric includes forming 500-1500 thread count per inch of fine textile fabric. The woven textile fabric has 50-89 ENDS PER INCH warp yarns per inch of cotton yarn or regenerated cellulose fiber yarn or a combination thereof (e.g., a combination thereof means cotton and regenerated cellulose fiber blended yarn) and of 20-40 NE (warp yarn count), wherein single yarn per dent may be setup in the reed apparatus of the warp of the loom apparatus. Additionally, the woven textile fabric comprises of 50-91 picks per inch in the weft in which each pick contains atleast 2-24 multi-filament polyester yarns. The picks are woven into the fabric using multi-filament weft yarns during a single pick insertion event of a pick insertion apparatus of a loom. Additionally, the warp to weft ratio of the woven fabric is atleast 1:5.

11 Claims, 2 Drawing Sheets

(51) Int. Cl.
*D03D 15/283* (2021.01)
*D03D 15/208* (2021.01)

(56) References Cited

U.S. PATENT DOCUMENTS

| | | | | |
|---|---|---|---|---|
| 9,474,395 | B2 | 10/2016 | Garg et al. | |
| 2012/0009405 | A1* | 1/2012 | Krishnaswamy | D03D 13/008 428/219 |
| 2014/0308865 | A1 | 10/2014 | Kumar et al. | |
| 2015/0047736 | A1* | 2/2015 | Agarwal | D03D 15/00 139/435.6 |
| 2016/0369433 | A1 | 12/2016 | Crawford et al. | |
| 2017/0314169 | A1 | 11/2017 | Agarwal | |
| 2018/0298529 | A1 | 10/2018 | Jhunjhunwala | |

* cited by examiner

WOVEN FABRIC MADE OF COTTON OR REGENERATED CELLULOSE FIBERS OR A COMBINATION THEREOF AND POLYESTERS

TECHNICAL FIELD

The present disclosure generally relates to textiles, and more particularly, relates to a woven fabric, a composition of the woven fabric and a method of weaving the fabric having enhanced thread count that produces a durable, wrinkle-free, high-strength, soft and affordable fabric.

BACKGROUND

Any fabric, for example, apparel or home textile is desirable depending upon the characteristics it possesses. For example, one of the important characteristics is the softness and/or luxurious feel the fabric can provide to the wearer wearing the fabric. Further, another characteristic may be the long-lasting ability of the fabric that can withstand different atmospheric and washing conditions with respect to piling, tearing, shrinkage, wrinkle resistance, dust resistance & overall appearance. In the current scenario, cotton fabric are the most preferred bedsheets; however, cotton sheets do not take care of most of the above features mentioned. Although cotton sheets have a smooth feel; however, the cotton sheets cannot correct all the above attributes mentioned. In order to overcome the aforementioned problems, new fabric weave construction & material is desired, which can solve all the above issues.

Typically, a fabric made using polyester yarns with small denier may increase the comfort & provide enhanced attributes such as wrinkle-free, luster and strength. These fine yarns having smaller denier may result in higher thread count. It must be noted herein that a thread count of a textile may be determined by counting the total weft yarns and warp yarns in along two adjacent edges of a square of fabric that is one-inch by one-inch. The thread count may be a commonly recognized indication of the quality of the textile, and the thread count may also be a measure that consumers associate with tactile satisfaction and opulence. High thread count in normal business practice may range from 500-1500.

However; there are various limitations faced by traditional fabric weaved with a mix of cotton in the warp and fine polyester in the weft namely seam stability of products in the existing product is weak, various kind of shrinkage issue is faced as 2 types of yarn quality is used which have different shrinkage ratio, softness of the current similar product in the market is limited. Above all, only those high thread count products are in the market that have a high ENDS PER INCH in the warp i.e. high thread count is directly related to ENDS PER INCH. Additionally, current High thread count products in the market usually have more than one yarn per dent setup in the reed apparatus of the warp of the loom apparatus.

SUMMARY

This summary is provided to introduce aspects related to a woven fabric made of cotton yarn or a regenerated cellulose fiber yarn or a combination thereof (In this context, combination means cotton & regenerated cellulose fiber blended yarn) and a polyester, a composition of the woven fabric and a weaving method thereof and are further described below in the detailed description. This summary is not intended to identify essential features of the subject matter nor is it intended for use in determining or limiting the scope of the subject matter.

In one embodiment, a woven fabric is disclosed, wherein the woven fabric comprises from 50 to 89 ends per inch warp yarns and from 50 to 91 picks per inch in the weft and each pick contains 2-24 multifilament polyester yarns/strands. In another aspect, the warp yarns may be made of cotton yarn or regenerated cellulose fiber yarn or a combination thereof (In this context, the combination means cotton & regenerated cellulose fiber blended yarn). In yet another aspect, the yarn count on the warp may be within a range of 20-40 count (Ne). In yet another aspect, the fabric may be weaved using air jet insertion apparatus or a rapier pick insertion apparatus.

In another embodiment, a method of weaving a fabric is disclosed. The method may include forming a fabric comprising from 50 to 89 ends per inch warp yarns and from 50 to 91 picks per inch in the weft & each pick contains 2-24 multifilament polyester yarns/strands. According to the method, the picks are woven into the fabric using multifilament polyester yarns. Additionally, the multi-filament polyester yarn is wound on yarn package to enable inserting of the multi-filament polyester yarn during a single pick insertion event of a pick insertion apparatus of a loom apparatus. In one aspect, the pick insertion apparatus of a loom apparatus may include an air jet insertion apparatus or a rapier pick insertion apparatus. According to the method, the multi-filament polyester yarns are wound on the multi-pick yarn package at an angle of a predefined range to enable the simultaneous inserting of the multi-filament polyester yarns during the single pick insertion event of the pick insertion apparatus of the loom apparatus. The woven fabric comprises from 50 to 89 ends per inch warp yarns and from 50 to 91 picks per inch in the weft & each pick contains 2-24 multifilament polyester yarns/strands. Furthermore, the yarn count on the warp may be within a range of 20-40 count (Ne).

In another aspect, a method of weaving a fabric includes drawing multiple polyester yarns from a weft source to a pick insertion apparatus of a loom apparatus. The method also includes conveying by the pick insertion apparatus the multiple polyester yarns across a warp shed of the loom apparatus through a set of warp yarns in a single pick insertion event of the pick insertion apparatus of the loom apparatus. Further, the method includes beating the multiple polyester yarns into a fell of the fabric with a reed apparatus of the loom apparatus such that the set of warp yarns and/or the multiple polyester yarns become interlaced into a woven textile fabric.

It must be understood herein that, in the present disclosure, the high thread count fabric is not directly related to ENDS PER INCH in the warp. Further, primarily one yarn per dent may be set up in the reed apparatus of the warp of the loom apparatus. It is to be noted herein that the advantage of a balanced ENDS PER INCH in the warp is the cost as ENDS PER INCH is directly related to the cost of the fabric, i.e. higher the Ends per Inch higher is the cost of the fabric. Additionally, the present disclosure solves the limitations faced by similar high thread count fabric available in the market. Additionally, the fabric is weaved in such a way that its strength is enhanced. The enhanced strength helps the fabric to go through a mechanical finishing process known as peaching/napping/liza which in-turn enhances the fabric feel and desirability. The current cotton warp & polyester weft cross weave fabric in the market may not be able to go through the above mechanical finishing process as the fabric may not be able to withstand the mechanical abrasion during the mechanical finish process thus resulting in the existing fabric in market to tear or pill drastically, if it undergoes the above mechanical process. Additionally, our fabric is weaved in such a way where embossing of a design on a woven fabric using a calendar heat press machine is possible. Embossing makes the fabric look like a jacquard weaved fabric. The embossing technology in woven fabrics is primarily possible in 100% polyester fabric only, however our unique construction and weave of the fabric makes it possible to emboss designs on our cotton-rich (cotton greater than 50%) woven fabric using calendar heat press machine

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer to like features and components.

FIG. 2 (*b*) depicts the setting of warp yarns using reed apparatus (203) of the loom apparatus, in accordance with an embodiment of the present disclosure.

DETAILED DESCRIPTION

Figure 1:
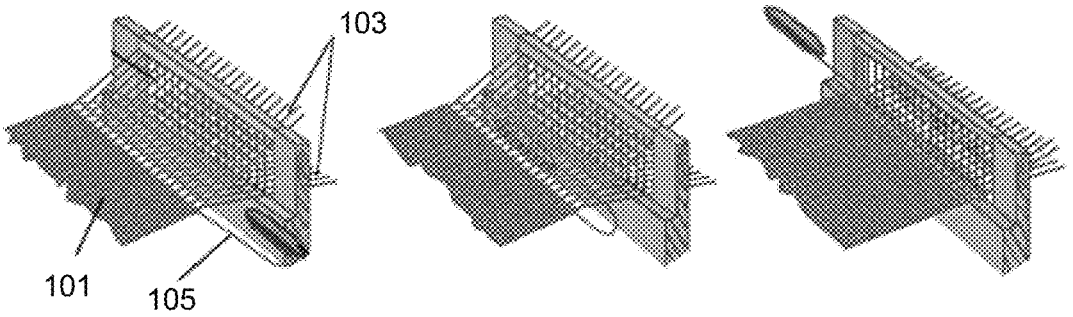
FIG. 1 (*a*), FIG. 1 (*b*), and FIG. 1 (*c*) illustrate different stages of a weaving process implemented using a weaving apparatus, in accordance with an embodiment of the present disclosure.

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that, the singular forms "a," "an," and "the" include plural references unless the context clearly dictates otherwise. Although any methods similar or equivalent to those described herein can be used in the practice or testing of embodiments of the present disclosure, the exemplary methods are now described. The disclosed embodiments are merely exemplary of the disclosure, which may be embodied in various forms.

Various modifications to the embodiment will be readily apparent to those skilled in the art and the generic principles herein may be applied to other embodiments. However, one of ordinary skill in the art will readily recognize that the present disclosure is not intended to be limited to the embodiments illustrated, but is to be accorded the widest scope consistent with the principles and features described herein.

Definitions

Terms used throughout this application are to be construed with ordinary and typical meaning to those of ordinary skill in the art. However, Applicants desire that the following terms be given the particular definition as defined below:

The terms ENDS PER INCH or "Ends per Inch" is the popular word in the garments & textile industry. Number of yarn in warp direction is measured by ENDS PER INCH. Normally, ends per Inch are the number of wrap threads. It is the represent vertical thread of the fabric. It is called the wrap yarn.

The term "warp" is the set of lengthwise yarns through which the weft is woven. Each individual warp thread in a fabric is called a warp end. Warp means "that which is thrown across".

The term "reed" means" a comb like device on a loom that separates the warp yarns and also beats each succeeding filling yarn against those already woven. The space between two adjacent wires of the reed is called a dent. The fineness of the reed is calculated by the number of dents to the inch. The more dents to the inch, the finer the reed."

The term "picking" means inserting weft threads across the warp through during weaving. Picking is the second primary motion in weaving. A single pick may contain 1-24 yarns. If the number of strands per pick is more than one, it is known as multi-strand yarn/plied yarn.

The term "Airjet" or "Airjet loom" or "Airjet loom apparatus" is a shuttleless loom capable of very high speeds that use an air jet to propel the filling yarn through the shed.

The term "Rapier" or "Rapier loom" or "Rapier loom apparatus" is a shuttleless weaving loom in which the filling yarn is carried through the shed of warp yarns to the other side of the loom by fingerlike carriers called rapiers.

The term "plain weave", also called "Tabby weave", is a simplest and most common of the three basic textiles weaves. The plain weave is made by passing each filling yarn over and under each warp yarn, with each row alternating, producing a high number of intersections.

The term "sateen weave" means a weave that typically has a glossy surface and a dull back, one of three fundamental types of textile weaves along with plain weave and twill. The satin weave is characterized by four or more fill or weft yarns floating over a warp yarn, four warp yarns floating over a single weft yarn.

The term "count" or "yarn count" refers to the thickness of yarn and is determined by its mass per unit length. It is usually measured by the number of grams per one kilometer of yarn, a unit of measure called "Tex". However, the spinning industry tends to use English cotton count, which is determined by the number of yarn hanks (each 840 yards long) per pound of yarn, and is notated "Ne".

The term "denier" is a direct-management type, employed internationally to measure the size of silk and man-made filaments and yarns, and derived from an earlier system for measuring silk filaments (based on the weight in drams of 1,000 yards). The number denier indicates the weight in grams of 9,000 meters of filament or filament yarn. For example, if 9,000 meters of a yarn weighs 15 grams, it is a 15-denier yarn; if 9,000 meters of a yarn weighs 100 grams, it is a 100-denier yarn and much coarser than the 15-denier yarn. Thus, a smaller number indicates a finer yarn.

Regenerated cellulose fiber is a class of materials manufactured by the conversion of natural cellulose to a soluble cellulosic derivative and subsequent regeneration, typically forming either a fiber (via polymer spinning) or a film (via polymer casting).

While aspects of the described woven fabric made of cotton yarn or regenerated cellulose fiber yarn or a combination thereof (In this context, combination means cotton & regenerated cellulose fiber blended yarn) and a polyester, a composition of the woven fabric and a weaving method thereof may be implemented in any number of different systems, environments, and/or configurations, the embodiments may be described in the context of the following exemplary system.

Referring now to FIGS. 1 (*a*), 1 (*b*) and 1 (*c*), different stages of a weaving process implemented using a weaving apparatus are illustrated, in accordance with an embodiment of the present disclosure.

As shown in FIG. 1 (*a*), a woven fabric 101 is illustrated. In one embodiment, the woven fabric may be a woven fabric textile marketed and sold by the applicant herein by the trade name "Lux Du Cotton/Mezcla De Fibre". As shown, the woven fabric is usually longer in one direction than the other. The lengthwise threads are called the warps 103, while the other threads, which are combined with the warps 103 and lie widthwise, are called the wefts 105.

Typically, in the all known methods of weaving, before a length of weft is inserted in the warp, the warp is separated, over a short length extending from the fabric already formed, into two sheets. The process is called shedding (as indicated in FIG. 1 (*a*)) and the space between the sheets is referred to as the shed. A pick of weft is then laid between the two sheets of warp, in the operation known as picking (as indicated in FIG. 1 (*b*)). A new shed is then formed in accordance with the desired weave structure, with some or all of the ends in each sheet moving over to the position previously occupied by the other sheet. In this way, the weft is clasped between two layers of warp.

Since it is not possible to lay the weft close to the junction of the warp and the cloth already woven, a further operation called beating in, or beating up (as indicated in FIG. 1 (*c*)), is necessary to push the pick to the desired distance away from the last one inserted previously. Although beating in usually takes place while the shed is changing, it is normally completed before the new shed is fully formed.

The sequence of primary operations in one weaving cycle is thus shedding (FIG. 1 (*a*)), picking (FIG. 1 (*b*)), and beating in (FIG. 1 (*c*)). At the end of the cycle, the geometrical relation of the pick to the warp is the same as it would have been if the pick had been threaded through the spaces between alternate ends, first from one side of the fabric and then from the other, as in darning. This is the reason the weaving process is considered an interlacing method.

In accordance with embodiments of the present disclosure, a woven fabric with enhanced durability, softness, wrinkle resistance, strength, and low cost is proposed. The woven fabric comprises from 50 to 89 ends per inch warp yarns and from 50 to 91 picks per inch in the weft in which each pick contains 2-24 multifilament polyester yarns/strands. In another aspect, the warp yarns may be made of cotton or regenerated cellulose fiber or a combination thereof (In this context, the combination means cotton & regenerated cellulose fiber blended yarn). In yet another aspect, the yarn count on the warp may be within a range of 20-40 count (Ne).

In accordance with embodiments of the present disclosure, the weaving method of the fabric may include cotton yarn or regenerated cellulose fiber yarn or a combination thereof (In this context, combination means cotton & regenerated cellulose fiber blended yarn) of count within a range of 20-40 (NE) in the warp 103, wherein the ENDS PER INCH of the warp 103 is within a range of 50-89. In the weft insertion step, multiple threads (yarns) of fine polyester yarns 105 may be inserted via single pick insertion in the apparatus (also known as picking). In one embodiment, the apparatus may include an air jet or rapier. In alternative embodiments, the looming apparatus such as bullet, magnetic levitation bullet, water jet, and the like may also be employed.

In each pick insertion, 2-24 threads/strands of multifilament polyester yarn per inch may be added in the weft of the woven fabric. In one embodiment, the minimum number of threads added per inch during the picking process per inch maybe 400 and maximum threads added per inch during the picking process per inch maybe 1500. In one embodiment, the multi-filament polyester yarns have a denier within a predefined range of 10 to 200. The weft yarn overlaps the warp yarn in the apparatus, in a one up one down weave also known as plain weave. The weave enhances the strength of the fabric. The mixture of the two different yarns and the unique weave construction increases the softness and the richness of the fabric while Ends per inch makes it light in weight & enhancing the wrinkle resistance of the fabric, makes it stain resistant & adds a quick dry feature to the fabric & makes it cost effective.

In one embodiment, a woven textile fabric includes from 50 to 89 ends per inch warp and from 50 to 91 picks per inch in the weft in which each pick contains 2-24 multifilament polyester yarns/strands. The picks are woven into the textile fabric (e.g., fabric 101) in groups of multi-filament polyester yarns 105 running in a parallel form to one another. The multi-filament polyester yarns 105 are wound parallel to each other.

In one embodiment, the multi-filament polyester yarns 105 are wound adjacent to one another to enable the simultaneous inserting of the multi-filament polyester yarns during a single pick insertion event of a pick insertion apparatus of a loom apparatus (e.g. air jet or rapier). In one embodiment, at least two multi-filament polyester yarns 105 wound using the single pick insertion and in a substantially parallel form to one another and substantially adjacent to one another.

In one embodiment, the multi-filament polyester yarns 105 are wound at an angle of within a predefined range of 15 and 30 degrees to enable the simultaneous inserting of the multi-filament polyester yarns 105 during the single pick insertion event of the pick insertion apparatus.

In one embodiment, the woven textile fabric (e.g., fabric 101) may be made of cotton yarn, regenerated cellulose fiber yarn or a combination thereof (In this context, the combination means cotton & regenerated cellulose fiber blended yarn) & multi-filament polyester yarns 105. In one embodiment, the woven textile fabric (e.g., fabric 101) may have a total thread count from 500 to 1500. In one embodiment, the yarn count on the warp is between 20-40 (Ne) count.

In another embodiment, a method of a woven textile fabric (e.g., fabric 101) includes forming 500 to 1500 threads per inch fine textile fabric. The method forms the woven textile having from 50 to 89 ends per inch warp yarns and the warp yarn count being 20-40NE, wherein single yarn per dent maybe setup in the reed apparatus of the warp of the loom apparatus 103 and from 50 to 91 picks per inch in the weft in which each pick contains 2-24 multifilament polyester yarns/strands 105. The picks are woven into the textile fabric 101 using multi-filament polyester yarns. Additionally, the method may include inserting of the multi-filament polyester yarn during a single pick insertion event of a pick insertion apparatus of a loom apparatus. Additionally, the warp to weft ratio of the woven fabric may be at least 1:5.

Additionally, the method also includes conveying by the pick insertion apparatus the multiple polyester yarns across a warp shed of the loom apparatus through a set of warp yarns 105 in a single pick insertion event of the pick insertion apparatus of the loom apparatus. Further, the method may include beating the multiple polyester yarns into a fell of the fabric (e.g., fabric 101) with a reed apparatus (not shown) of the loom apparatus such that the set of warp yarns 103 and/or the multiple polyester yarns 105 become interlaced into a woven textile fabric 101, according to one embodiment. In one embodiment, the warp to fill ratio of the fabric is between 1:5 and 1:20 (i.e. between 1 yarn in the warp to 5 yarns in the wefts and 1 yarn in the warp to 20 yarns in the wefts).

Figure 2:
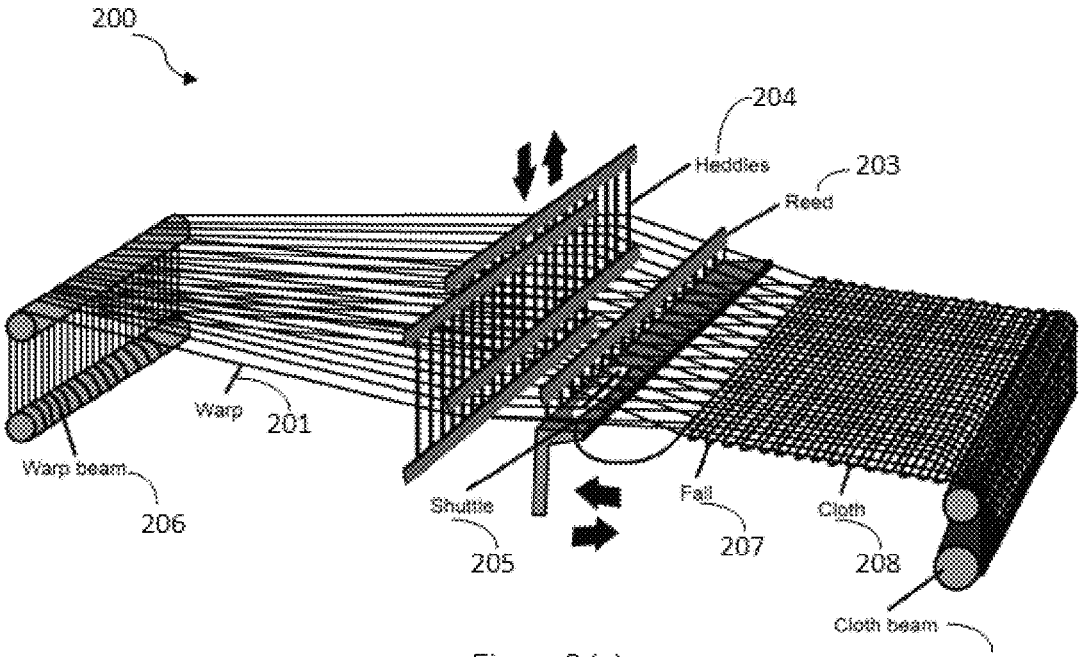
FIG. 2 (*a*) illustrates a loom apparatus 200, in accordance with an embodiment of the present disclosure.
Figure 2:
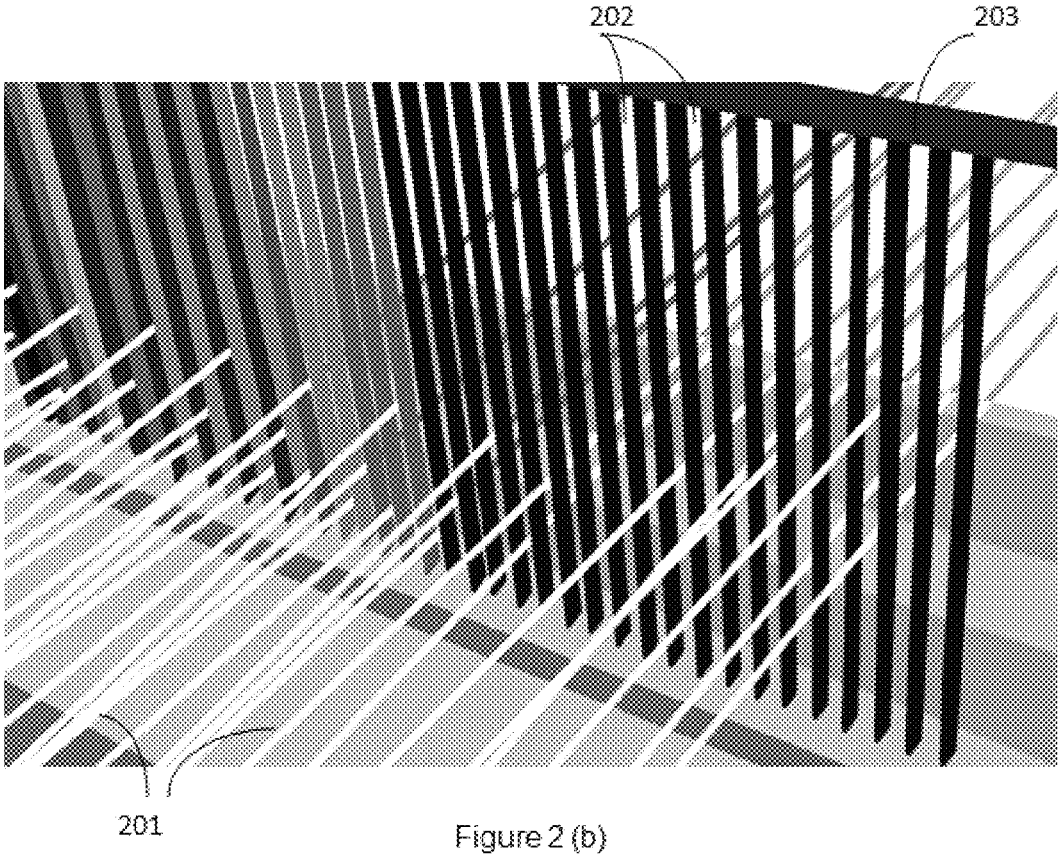

FIG. 2 (*a*) illustrates a loom apparatus 200, in accordance with an embodiment of the present disclosure. As shown the loom apparatus (200) comprises the reed apparatus (203) collectively facilitating the process of forming a cloth (208) to obtain cloth beam (209). A warp (201) from a warp beam (206) is set up per dent in the reed apparatus (203) of the loom apparatus 200. FIG. 2 (*b*) depicts the setting of warp yarns (201) using reed apparatus (203) of the loom apparatus (200), in accordance with an embodiment of the present disclosure. As shown in FIG. 2 (*b*), a gap between two stands (indicated in dark) represents a dent (202) through which a warp yarn (indicated in white color) is set up in the reed apparatus (comb like apparatus). The functions of the components Heddles (204), shuttle (205), and fall (207) is as per the teachings known in the art and hence have not be explained for the sake of brevity.

Some embodiments of the present disclosure enable in forming a woven fabric with long lasting durability.

Some embodiments of the present disclosure enable in forming a woven fabric having a courser count yarn in warps, wherein the courser count yarn has higher surface area and is economical than finer yarns. The coarser count yarn increases the surface area covered by the yarn in the fabric. A higher surface area is provided to the warp yarn.

Some embodiments of the present disclosure enable in forming a woven fabric having a fine polyester yarn in wefts, wherein the finer polyester yarn is economical in comparison to any other material in fine count yarn, is smoother, has lower surface area per thread and is very strong. Further, the fine polyester yarns result in forming a wrinkle resistant, strong, smooth, and high thread count.

Some embodiments of the present disclosure enable in forming a woven fabric having a cotton yarn or regenerated cellulose fiber yarn or a combination thereof in warp, wherein the said fiber yarn is softer, breathable, comfortable, and drapes well.

Some embodiments of the present disclosure enable in forming a woven fabric via combination of courser count yarn on the warp and fine polyester yarns on the weft which makes the fabric naturally soft. The warp yarn is courser thus covers higher surface area, while the super fine polyester yarn surface area per thread is lower and hence the air can easily pass around the super fine polyester threads and easily absorbed by warp fiber yarn.

Although implementations for apparatus(s) and method(s) of forming a woven fabric textile with high thread count, enhanced durability, softness, wrinkle resistance, strength, and low cost have been described in language specific to structural features and/or methods, it is to be understood that the implementations and/or embodiments are not necessarily limited to the specific features or methods described. Rather, the specific features and methods are disclosed as examples of implementations for forming a woven fabric textile with high thread count, enhanced durability, ultimate softness, wrinkle resistance, light in weight and low cost.

I claim:

1. A woven textile fabric, comprising:

cotton yarn or regenerated cellulose fiber yarn or a combination thereof included within warp yarns within a predefined range of 50 to 89 ends per inch in the warp; and 50 to 91 picks per inch in the weft in which each pick in the weft to have 2 to 24 strands/yarns of multi-filament polyester yarns, wherein at least a single yarn in each dent is setup in a reed apparatus of the warp of a loom apparatus, wherein the warp to fill ratio of the fabric is between 1:5 and 1:20 such that a total thread count of the textile fabric is within a predefined range of 500 to 1500 per inch, wherein the multi-filament polyester yarns are wound on a single-strand or multi-strand yarn package at an angle of between 15 and 30 degrees to enable the simultaneous inserting of the multi-filament polyester yarns during a single pick insertion event of the pick insertion apparatus of the loom apparatus, wherein at least one single-strand yarn package or at least one multi-strand yarn package or a combination thereof is configured for the weft insertion during the single pick insertion event of the pick insertion apparatus of the loom apparatus, and wherein the yarn count of the warp yarn is between 20-40 (Ne) count.

2. The woven textile fabric of claim 1, wherein the pick insertion apparatus of the loom apparatus is at least one of an air jet pick insertion apparatus or a rapier pick insertion apparatus.

3. The woven textile fabric of claim 1, wherein the multi-filament polyester yarns have a denier within a predefined range of 10 to 200.

4. The woven textile fabric of claim 1, wherein the minimum and the maximum number of multi-filament polyester yarns/strands added per inch during the picking process per inch ranges from 400 to 1500 respectively in the weft.

5. The woven textile fabric of claim 1, wherein the fabric is weaved in form of a plain weave or a sateen weave.

6. A woven textile fabric, comprising:

cotton yarn or regenerated cellulose fiber yarn or a combination thereof warp yarns within a predefined range of 50 to 89 ends per inch in the warp; and 50 to 91 picks per inch in the weft in which each pick in the weft to have 2 to 24 strands/yarns of multi-filament polyester yarns;

wherein at least a single yarn in each dent is setup in a reed apparatus of the warp of a loom apparatus;

wherein at least one single-strand multi-filament polyester yarn package or atleast one multi-strand multi-filament polyester yarn package or a combination thereof is configured for the weft insertion to enable inserting of the multi-filament polyester yarns during a single pick insertion event of the pick insertion apparatus of the loom apparatus, wherein the multi-filament polyester yarns is wound on the single-strand yarn package or the multi-strand yarn package at an angle of between 15 and 30 degrees to enable the simultaneous inserting of the multi-filament polyester yarns during the single pick insertion event of the pick insertion apparatus of the loom apparatus, wherein the pick insertion apparatus is configured to convey at least two multi-filament polyester yarns across the warp shed of the loom apparatus through a set of warp yarns in the single pick insertion event of the pick insertion apparatus of the loom apparatus, and wherein the warp to fill ratio of the fabric is between 1:5 and 1:20 such that a total thread count of the textile fabric is within a predefined range of 500 to 1500 per inch.

7. The woven textile fabric as claimed in claim 6, wherein the multi-filament polyester yarns have a denier within a predefined range of 10 to 200.

8. The woven textile fabric as claimed in claim 6, wherein the minimum and the maximum number of multi-filament polyester yarns/strands added per inch during the picking process per inch ranges from 400 to 1500 respectively in the weft.

9. The woven textile fabric as claimed in claim 6, wherein the yam count of the warp yam is between 20-40 (Ne) count.

10. The woven textile fabric as claimed in claim 6, wherein the fabric is weaved in form of a plain weave or sateen weave.

11. The woven textile fabric as claimed in claim 6, wherein the fabric is weaved either on air jet loom apparatus, rapier loom apparatus or sulzer loom apparatus.

* * * * *